US006892506B2

(12) United States Patent
Skublevitz

(10) Patent No.: US 6,892,506 B2
(45) Date of Patent: May 17, 2005

(54) ADJUSTABLE DOOR

(75) Inventor: Avi Skublevitz, Kiryat Ono (IL)

(73) Assignee: Mifalei Karmiel Ltd., Karmiel (IL)

( * ) Notice: Subject to any disclaimer, the term of this patent is extended or adjusted under 35 U.S.C. 154(b) by 76 days.

(21) Appl. No.: 10/394,572

(22) Filed: Mar. 24, 2003

(65) Prior Publication Data

US 2004/0187427 A1 Sep. 30, 2004

(51) Int. Cl.[7] ..... E06B 1/04

(52) U.S. Cl. ..... 52/784.1; 52/784.16; 52/656.4; 52/217; 49/505

(58) Field of Search ..... 52/217, 210, 783.12, 52/784.1, 800.13, 656.4, 656.2, 783.1, 784.16; 49/124, 501, 505

(56) References Cited

U.S. PATENT DOCUMENTS 2,583,989 A 1/1952 Bamberg
4,777,765 A * 10/1988 Johnson, Jr. ..... 49/55
5,291,688 A 3/1994 Pederson
5,845,439 A 12/1998 Hendley
5,921,059 A * 7/1999 Farra ..... 52/800.13
6,058,665 A * 5/2000 Halvorson et al. ..... 52/205
6,530,183 B1 * 3/2003 Kuei-Yung ..... 52/204.1

FOREIGN PATENT DOCUMENTS

NL 1004399 C 8/1987

* cited by examiner

*Primary Examiner*—Naoko Slack
*Assistant Examiner*—Jennifer I. Thissell
(74) *Attorney, Agent, or Firm*—Browdy and Neimark, P.L.L.C.

(57) ABSTRACT

The present invention provides a door with an adjustable height and an adjustable width. The door of the invention comprises a central unit, a bottom unit overlapping with the central unit to define a bottom overlapping region, a side unit overlapping with the central unit to define a side overlapping region, and a corner unit overlapping with the side unit and with the bottom unit. The height of the door may be adjusted by changing the size of the bottom overlapping region. The width of the door may be adjusted by changing the size of the side overlapping region. The corner unit is attached to the bottom unit and to the side unit in a manner ensuring that the shape of the door as a whole is rectangular at any height and width to which the door is adjusted.

18 Claims, 5 Drawing Sheets

ADJUSTABLE DOOR

FIELD OF THE INVENTION

This invention relates to adjustable doors, and particularly to doors that have both height and width that are adjustable.

BACKGROUND OF THE INVENTION

Generally, when one wishes to hang a door in a door-frame, one has first to measure the door frame very accurately and order a door prepared exactly according to the dimensions of one's door-frame. This rather expensive routine may be omitted by an adjustable door.

U.S. Pat. No. 5,845,439 describes an adjustable door and frame assembly adapted to fit door openings of different sizes. The door is:made up of a core piece having a plurality of height and width extension members which may be removably attached thereto to change the dimensions of the door.

U.S. Pat. No. 5,291,688 describes a door assembly, arranged for accommodating adjustment relative to a door fine, comprising a door with first and second end wall caps mounted to the first and second ends of the door wherein the caps are arranged for pivoted adjustment relative to the first and second door ends.

U.S. Pat. No. 4,777,765 describes a gate comprised of two segments slidably adjustable to variable width doorways.

SUMMARY OF THE INVENTION

The present invention provides a closure, such as a door or a window for a framed opening. For the sake of simplicity the closure will be referred hereinafter as a door. The door according to the invention is adjustable in its height and width, so that fitting to an existing same does not require preparatory measurements. Furthermore, a door according to the invention frees one from the need to have in one's house openings in standard dimensions, and allows more flexibility in planning the openings in one's house.

The door according to the invention comprises a central unit, a bottom unit overlapping with said central unit to define a bottom overlapping region, a side unit overlapping with said central unit to define a side overlapping region, and a corner unit overlapping with said side unit and with said bottom unit. The height of the door is adjustable by changing the size of said bottom overlapping region, for instance by moving the bottom unit upwards and downwards in respect of the central unit. The width of the door is adjustable by changing the size of said side overlapping region, for example by moving the side unit inwardly and outwardly in respect of the central unit. The corner unit is attached to the bottom unit and to the side unit in a manner ensuring that the shape of the door as a whole is rectangular at any height and width to which the door is adjusted.

According to one embodiment of the invention, each of the bottom and side units has a cavity capable of receiving therein a portion of the central unit and, possibly also portions of one or more of the units. This receiving of one unit by another creates an overlap between them.

According to other embodiments of the invention at least one of the side or bottom units may have a protrusion, that overlaps with a cavity in the central unit.

Preferably, the bottom unit has an upper portion and a lower portion with the upper portion having width substantially equal to that of the central unit. Here and in the following description and claims, two units are said to have dimensions that are 'substantially equal'if one of them may snugly receive the other one along said dimension.

The positions of the bottom, side, and corner units may be adjusted to produce a door having the required height and width and these units may be fixed in these positions by suitable fixing means. Non-limiting examples of such fixing means may be nails, bolts, rivets, and the like. Some non-limiting examples of more sophisticated fixing means are described below.

According to one embodiment of the present invention, the door has a first: and a second side units, a first and a second corner units, so that the width of the door may be adjusted by the positioning of two side units.

It is possible to built such a door with hinge pins and/or hinge pin sockets on one of the side units and a lock on the other. The two side units may be made interchangeable, so that each of them may be on the right while the other is on the left. This way, the door may swing from the right or from the left according to a decision made during the mounting thereof, and no special orders and preparations should be made in advance in this respect.

The side units may be adjusted and fixed in relation to the central unit by means of a screw. For this purpose a retention ring, fixed to a suitable support should be added within the side unit, and a nut should be attached to the central unit. Thus, a screw, having its head fixed to the support by said retention ring and its threaded part going through said nut may control the movement of the central unit in respect of the side unit.

According to a preferred embodiment of the present invention there is provided a door having a central unit, a top unit a bottom unit, two side units and two corner units, wherein the two side units move outwardly and inwardly in a coordinated manner, so that their movement is symmetric in respect of the central unit.

This may be achieved by the two side units being connected by a screw, which goes through the central unit. This screw has two threaded portions, one right threaded and the other left threaded. In each of the side units there is a support for a nut and a nut fixed thereto, one of the nuts being right threaded and the other being left threaded. Retention rings are used to fix the screw to the central unit in the two points the screw penetrates it. An aperture in the outer side of one of the side units allows accessing the screw with a screw-driver from the outside of the door, preferably on the side unit equipped with hinges, so when the door is mounted the aperture is less apparent to the eye than if it is on the lock side.

BRIEF DESCRIPTION OF THE DRAWINGS

In order to understand the invention and to see how it may be carried out in practice, a preferred embodiment will now be described, by way of non-limiting example only, with reference to the accompanying drawings, in which

FIG. 4 illustrates a door according to another embodiment of the present invention; a retention ring (used in the embodiment illustrated in FIG. 4) is shown in: FIG. 4*a;*

DETAILED DESCRIPTION OF THE INVENTION

Figure 1:
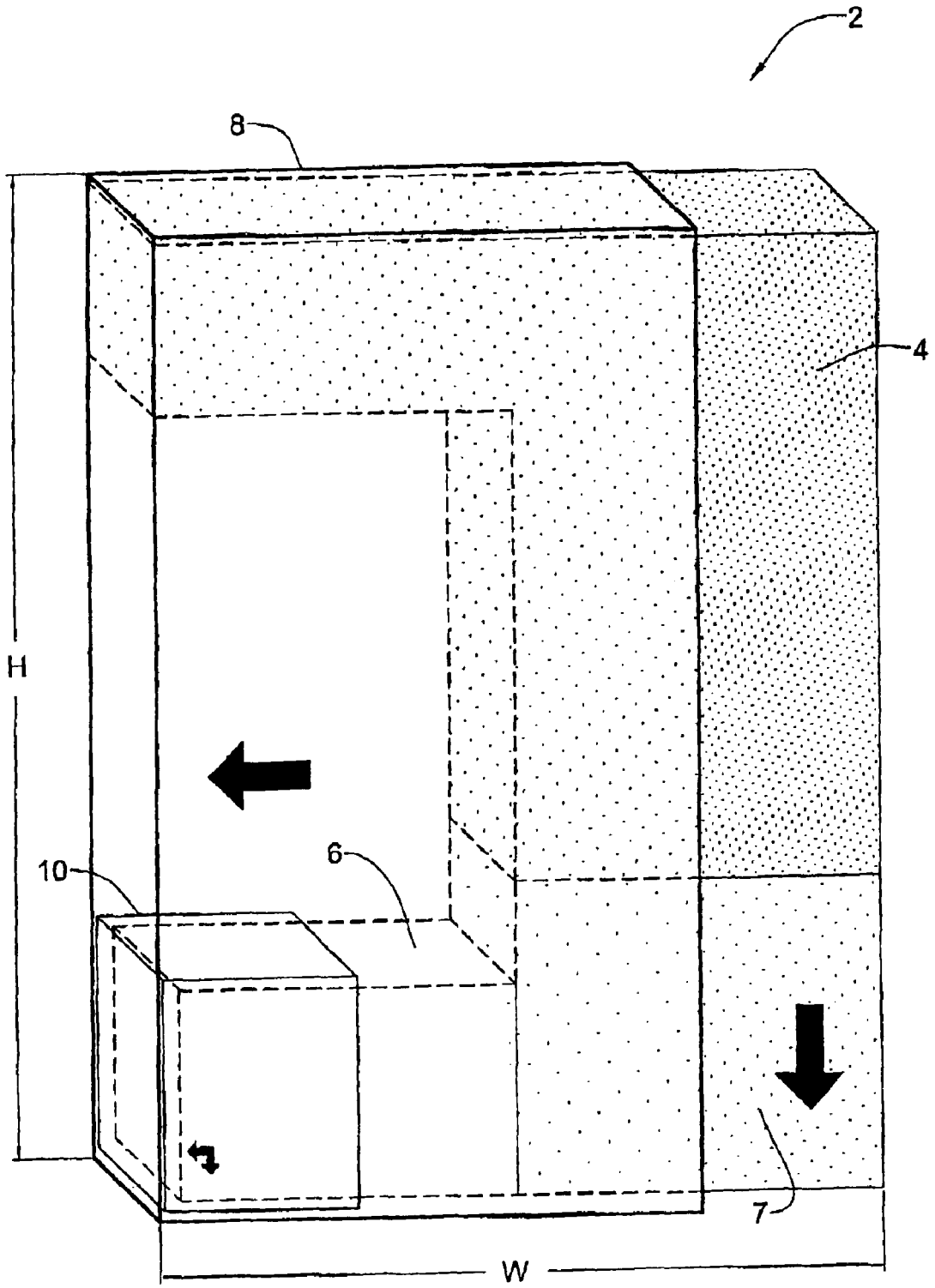
FIG. 1 illustrates a door according to one embodiment of the present invention at its minimal dimensions.

FIG. 1 illustrates a door 2 according to the invention, being adjustable in its height H and width W, so that fitting to an existing frame (not shown) does not require preparatory measurements. FIG. 1 shows the door 2 when it is in its minimal dimensions, H and W, and FIG. 2 shows a corner of the door 2 when adjusted to its largest dimensions.

The door 2 comprises a central unit 4, a bottom unit 6 overlapping with the central unit to define a bottom overlapping region 7, a side unit 8 overlapping with the central unit 4 to define a side overlapping region, and a corner unit 10 overlapping with said side unit 8 and with said bottom unit 6. The hatching of the various portions of the central unit 4 in FIG. 1 is in accordance with the position of each portion in respect of the viewer, so that the visible portion of the central unit is hatched with the most dense hatching aid portions that are overlapped by portions of two units (6 and 8) have the least dense hatching. Therefore, the overlapping region 7 is has two different hatching patterns. The height H of the door 2 is adjustable by changing the size of the bottom overlapping region 7 by moving the bottom unit 6 upwards and downwards in respect of the central unit 4. The width W of the door 2 is adjustable by changing the size of the side overlapping region by moving the side unit 8 inwardly and outwardly in respect of the central unit 4. The height of the side unit 8 is substantially equal to that of the central unit 4.

A corner unit 10 is attached to the bottom unit 6 and to the side unit 8 in a manner ensuring that, as a whole, the shape of the door 2 is rectangular at any height and width to which the door is adjusted.

Figure 2:
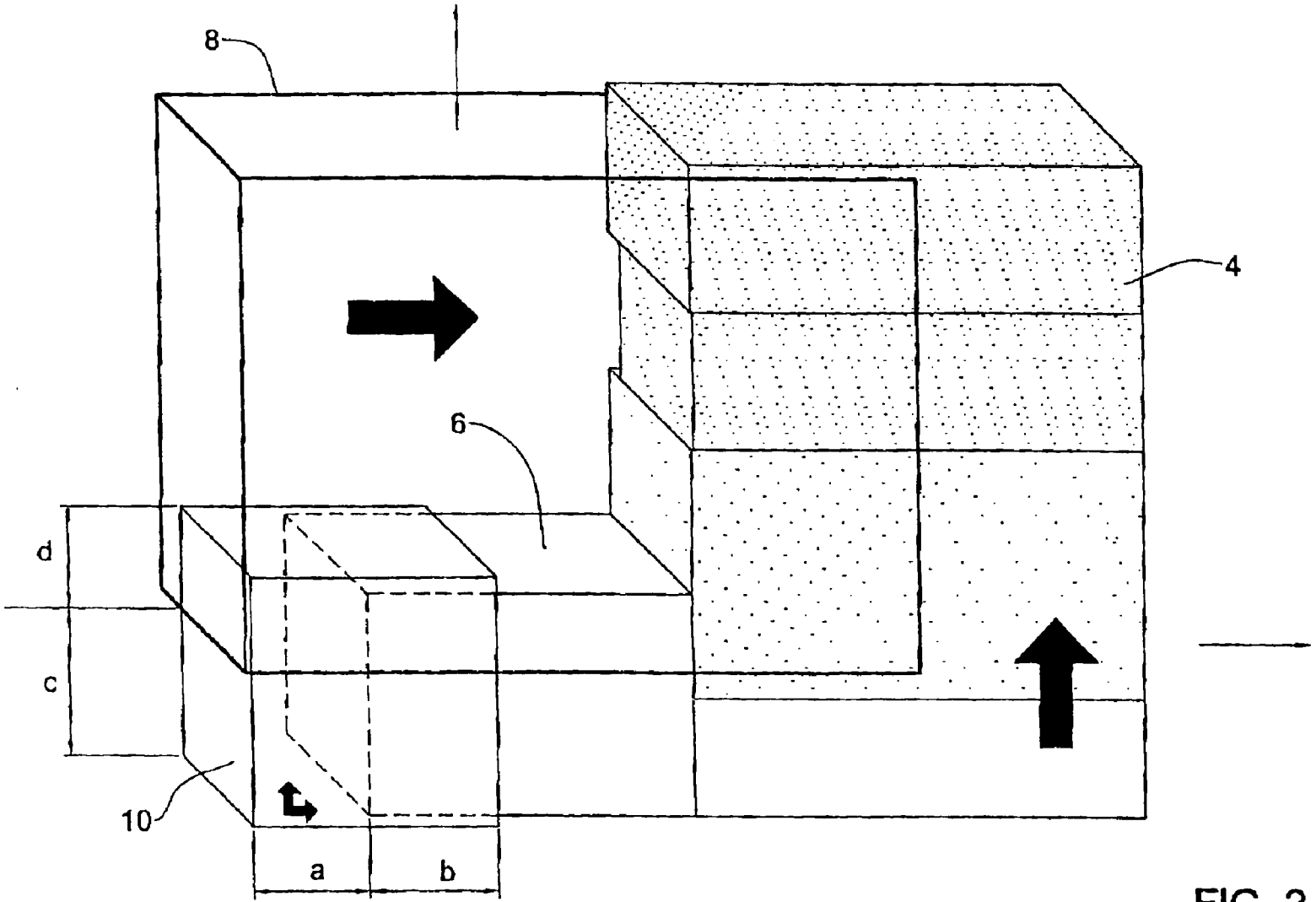
FIG. 2 illustrates a corner of the door shown in FIG. 1 when opened to maximal dimensions.

FIG. 2 illustrates the bottom left corner of the door 2, when the door is opened to its maximal dimensions. Parts appearing in FIG. 1 and 2 are given the same reference numerals in the two figs.

In the embodiment illustrated in FIGS. 1 and 2, each of the bottom unit 6 and side unit 8 has a cavity capable of receiving therein a portion of the central unit and possibly also portions of one or more of the units.

According to other embodiments of the invention (one of which has a central unit like the one illustrated in FIG. 5 below) at least one of the side or bottom units may have a protrusion, that overlaps with a cavity in the central unit.

The structural requirements form the various units is explained below in view of their function in adjusting the door 2. The implications with regard to the other embodiments are self-explanatory.

Figure 3:
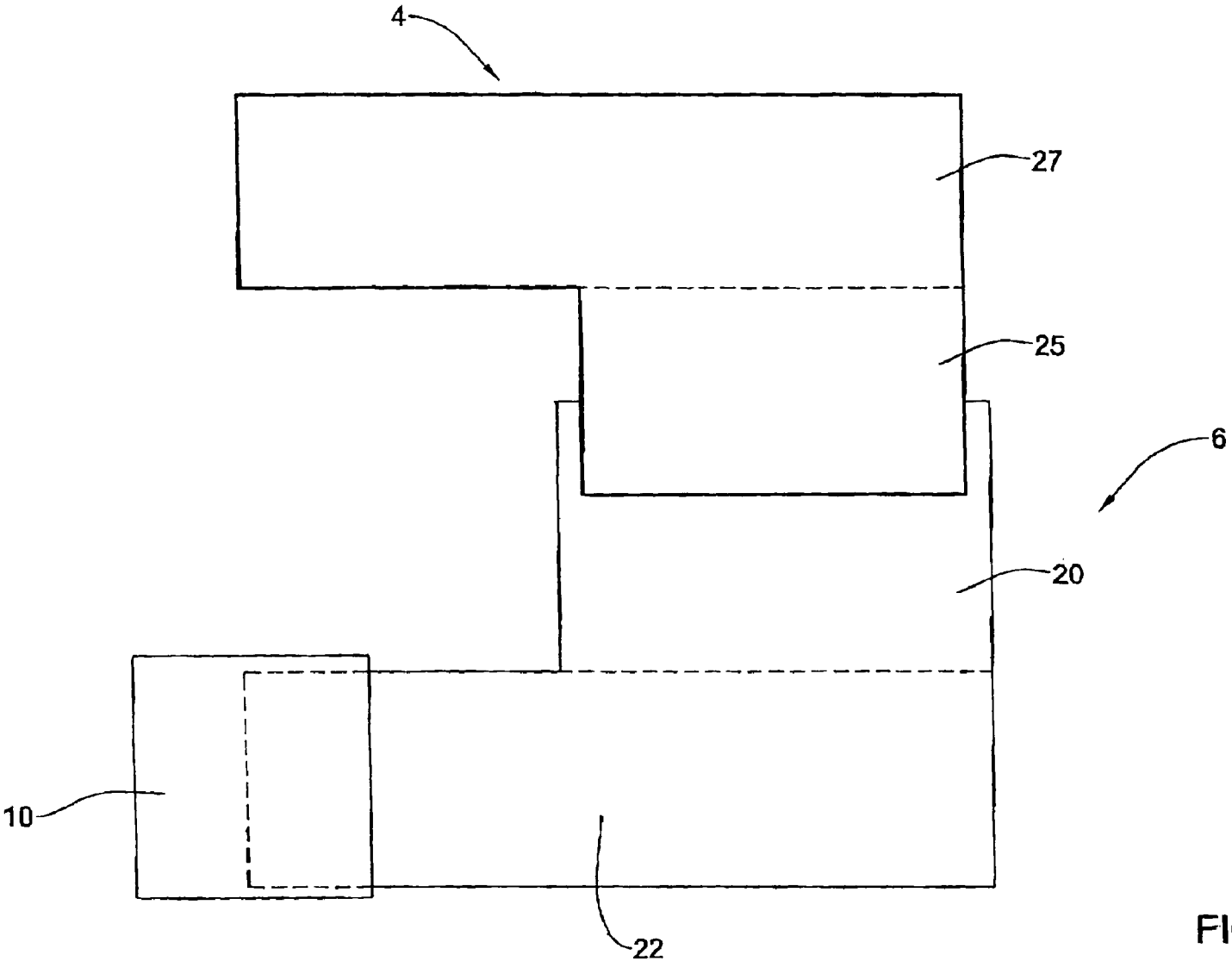
FIG. 3 shows the general structure of the bottom unit and the central unit of the door in FIGS. 1 and 2.

As shown in FIG. 3, the central unit 4 has a main portion 25 and a top portion 27, and the bottom unit 6 has an upper portion 20 and a lower portion 22. For illustration only, the portions of each of the units are separated from each other by dashed lines. The width of the upper portion 20 of the bottom unit 6 is substantially equal to that of the main portion 25 of the central unit 4. The lower portion 22 of the bottom unit 6 should be wider than the upper portion 20, in order to have a portion overlapping with the corner unit 10, as described below. The top portion 27 of the central unit 4 should be as wide as the lower portion 22 of the bottom unit 6, in order to allow the side portion, 8 to overlap with both portion 22 and 27 while retaining a right angel with them.

The width of the cavity of the side unit 8 should be at least as large as the sum of the sizes a) and b) (see FIG. 2) wherein a) is the extent to which it is desirable to adjust the width of the door 2, and b) is the minimal al size of the portion of the central unit 4 that the side unit 8 should receive therein in order to maintain the firmness of the door.

The vertical dimension of the corner unit 10 should be substantially equal to that of the lower portion 22 of the bottom unit 6. This dimension should be the sum of two terms c) and d) wherein c) is the extent to which it is desirable to adjust the height of the door 2 and d) is the minimal size of that part of the lower portion 22 of the bottom unit 6 that the side unit 8 should overlap in order to maintain the firmness of the door.

Which one of the corner, bottom and side units 10, 6 and 8 receives therein portions of which unit may depend upon the specific embodiment however, in all the embodiments, it will be possible to maintain the above-described functionality.

Figures 4, 4A:
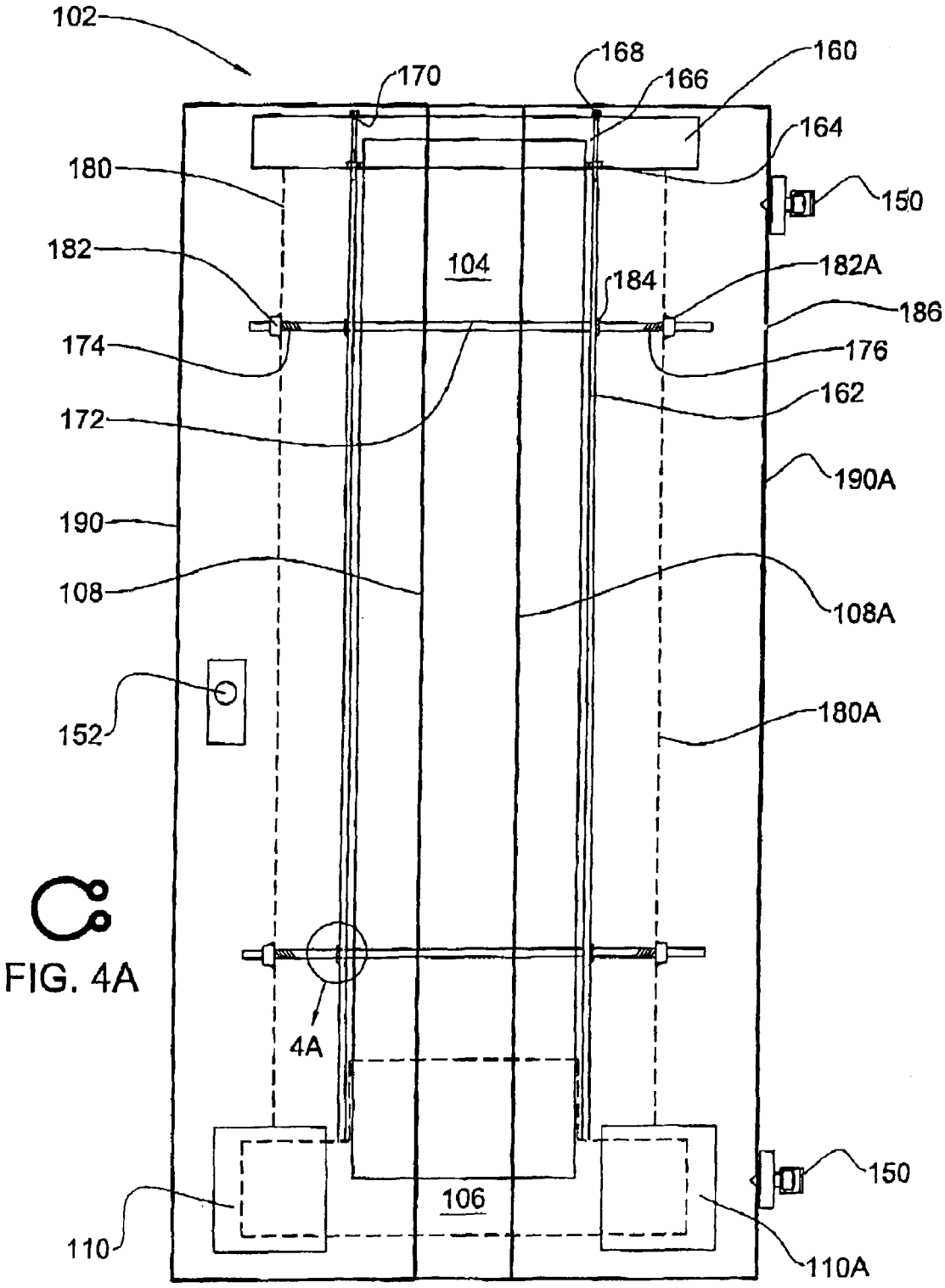

FIG. 4 illustrates another embodiment of the invention showing a door 102. Components of the door 102 that are equivalent to those explained above regarding the door 2 have the same reference numerals increased by 100. The door 102 has ah additional side unit 108A and an additional corner unit 110A, so that the width of the door may be adjusted by positioning of two side units 108 and 108A. The door 102 has hinge pins or hinge pin sockets 150 on the side unit 108A and a lock 152 on the side unit 108. Side units 108 and 108A are interchangeable, and by interchanging them the lock 152 may be on the right-hand side of the door 102 and the hinges 150 may on its left-hand side. Thus, the door 102 can be adjusted lo swing to open form its right side or its left side.

The door 102 further comprises a top unit 160, being an upper part of the central unit 104 having a fixed position in relation thereto. Top unit 160 is connected to the lower portion of the bottom unit 106 so as to add firmness to the door 102. The top unit 160 and the bottom unit 106 are connected by means of one or more rods 162 that are fixed to the lower portion of the bottom unit 106 (for example by nailing, welding, or any other method suitable to the material(s) from which the bottom unit 106 is made). The rods 162 have at their top side a nut 164, to receive therein a screw 166, having its head 168 outside the top unit 160, the screw 166 being fixed to the top unit 160 by a retention ring 170. A detailed view of a retention ring is given in FIG. 4A. This way, the adjustment of the height of the door may be done by tightening and loosening the screw 166. Such an assembly of rods and screws functions as both an adjustment means and a fixing means, since the door will maintain its height as long as the screw is not loosened or tightened.

According to another embodiment (not shown), the top portion of the central unit and the bottom unit may be connected by ropes, tied at one end to the bottom unit and on the other to a ring attached to a screw, where turning the screw adjusts the height of the door as described in the previous embodiment. Such an assembly of rods (or ropes) and screws may also function as fixing means, since the door will maintain its height as long as the screw is not loosened or tightened.

The position of the two side units 108 and 108A may similarly be adjusted and fixed. Furthermore, they may be moved inwardly or outwardly in a coordinated manner, so that their movement is symmetric in respect of the central unit 104, and turning each of at least one screw 172 results in a movement of both units.

This is achieved by connecting the two side units 108 and 108A by the screw 172, that goes through the central unit 104 and has at its ends a right threaded portion 174, and a left threaded portion 176. In the side units 108 and 108A there are supports 180 and 180A and nuts 182 and 182A fixed to their respective supports. Nut 182 is right threaded and nut 182A is left threaded, to suit the sides of the screw 172. If the side units are interchanged, the screw 172 has to be turned so that its right threaded end 174 will turn to the right threaded nut 182. Alternatively, the support 180 with nut 182 may be installed in the side unit 108A and the support 180A and the nut 182A installed in the unit 108 with the nuts on them may be interchanged between the side units.

The supports may be attached to the side unit as illustrated in FIG. 4, preferably, they may form a single support going through the entire height of the side unit.

Retention rings 184 are used to fix the screw 172 to the central unit 104 where the screw 172 penetrates it, to ensure that turning the screw will result in a horizontal movement of the side units 108 and 108A and not in that of the screw. An aperture 186 in the outer side of the side unit 108A allows accessing the screw by a screwdriver (not shown) from the outside of the door. The aperture may be closed with a suitable cap after the door is mounted. The screw 172 is preferably an Allen screw.

The extent to which the width of the door 102 may be adjusted is limited by the distance between the supports 180 and 108A and the outer walls 190 and 190A of the side units 108 and 108A, respectively, since tightening and loosening of the screw 172 is possible only as long as its head remains between the support and the outer wall.

Although in some embodiments a single screw such as screw 172, positioned near the center of the side units 108 and 108A may suffice, it is usually desirable to have at least two such screws, as illustrated in FIG. 4. Furthermore, by tightening the screws to different degrees it is possible to adapt the door to openings that are not right-angled.

Figure 5:
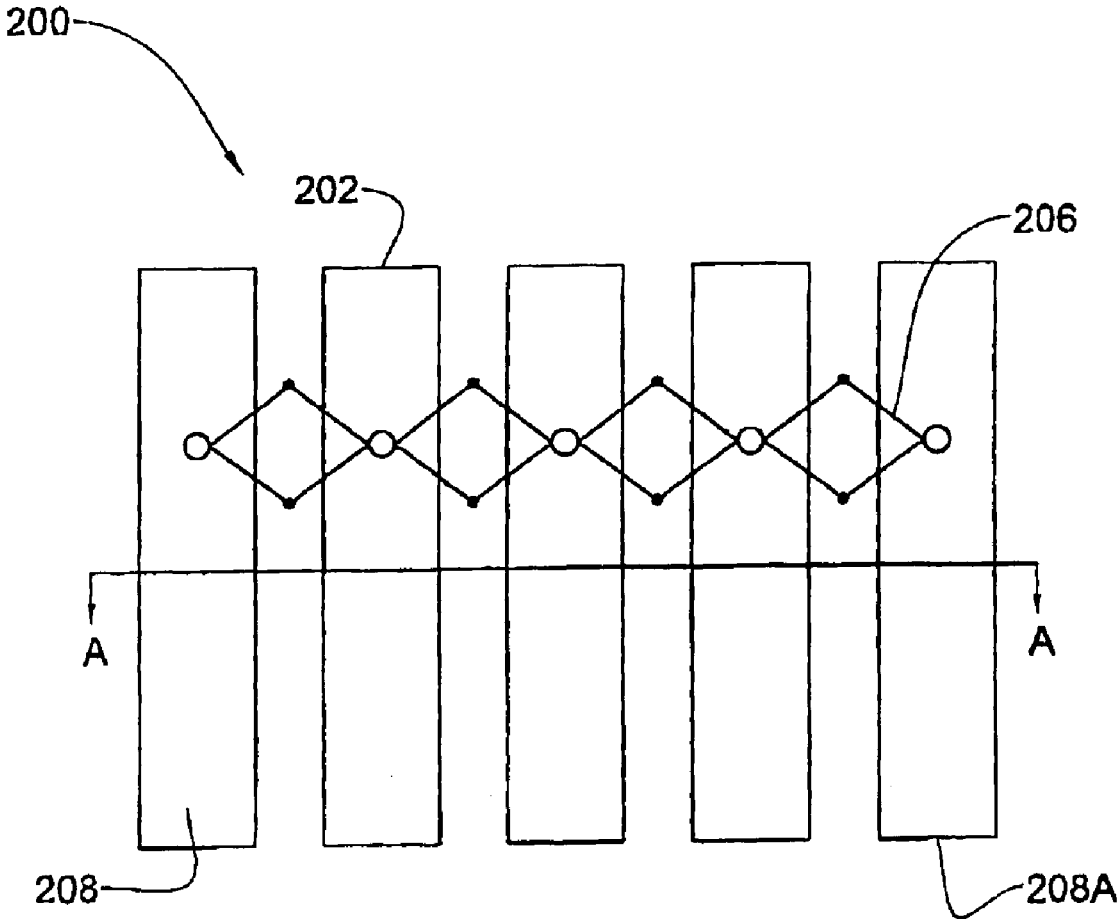
FIG. 5 illustrates a specific kind of a central unit useful with the door of FIG. 4.
Figure 6:
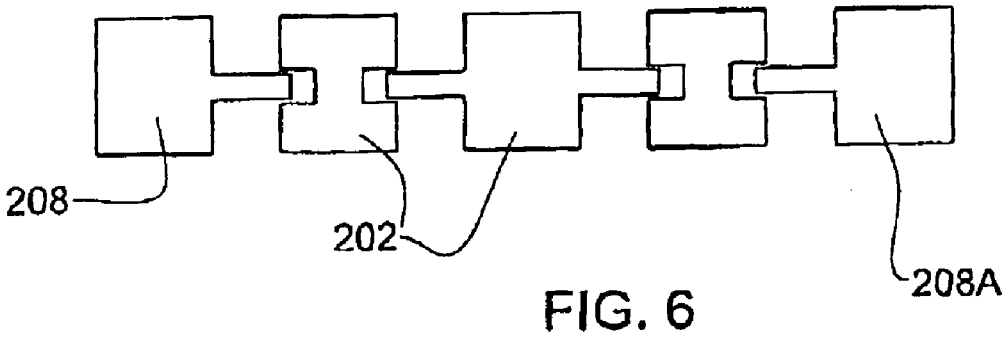
FIG. 6 is a cross-section in the central unit of FIG. 5.

FIG. 5 describes a central unit 200 for use in a door such as the door 102 described in FIG. 4. The central unit 200 is made of a plurality of members 202 movable in respect of each other. As illustrated in FIG. 6, showing a cross-section A—A in the unit 200, each of the members 202 has at least one neighboring member and overlaps therewith. The members 202 of the central unit 200 and the side units 108 and 108A may be moved in a coordinated manner. This is achieved by connecting all the members 202 to a pantograph 206 that is connected to the screw 172 of the door 102 so that the pantograph may be contracted or extended according to the tightening or loosening of the screw. In this embodiment the edge members 208 and 208A do not move in relation to the side units 108 and 108A, so that member 208 may be considered a portion of the side unit 108 and member 208A may be considered a portion of side unit 108A. Thus, when the central unit 200 replaces the central unit 104 of the door 102, the resulting embodiment has side units (comprised, for example, of the parts 108 and 208) with protrusions that are, received in a central unit similar to central unit 200, but does not include members 208 and 208A.

What is claimed is:

1. A door with an adjustable height and an adjustable width, comprising, a central, unit a bottom unit overlapping with said central unit to define a bottom overlapping region, a side unit overlapping with said central unit to define a side overlapping region, and a corner unit overlapping with said side unit and with said bottom unit;

said height being adjustable by changing the size of said bottom overlapping region;

said width being adjustable by changing the size of said side overlapping region; and the corner unit is attached to the bottom unit and to the side unit in a manner ensuring that the shape of the door as a whole is rectangular at any height and width to which the door is adjusted;

wherein the central unit has a main portion and a top portion with the top portion having a width equal to that of the lower portion of the bottom unit.

2. A door according to claim 1 wherein the bottom unit has an upper portion and a lower portion with the tipper portion having width substantially equal al to that of the central unit and the lower portion being wider than said upper portion.

3. A door according to claim 1 wherein the side unit has a cavity capable of receiving therein a portion of the central unit.

4. A door according to claim 1 wherein the central unit has a cavity capable of receiving therein portion of the side unit.

5. A door according to claim 1 further comprising means for fixing of the units in respect of the central unit.

6. A door according to claim 1 comprising a first and a second side its and a first and a second corner units, so that the width of the door may be adjusted by positioning of said first and second side units in respect of the central unit.

7. A door according to claim 6 having hinge pins or hinge pin sockets on said first side unit and a lock on said second side unit.

8. A door according to claim 7, wherein said first side unit is interchangeable with said second side unit so that the door may be mounted to swing from the right or from the left.

9. A door according to claim 1 wherein the top portion of the central unit and the lower portion of the bottom unit are connected so that the position of the bottom unit in relation to the central unit may be controlled from the top portion of the, central unit.

10. A door according to claim 1 wherein the top portion of the central unit and the lower portion of the bottom unit are connected by rods that are fixed to the lower part of the bottom unit; each of said rods having in a top side a nut, to receive therein a screw or threaded rod, having a head outside the central unit.

11. A door according to claim 10 having a side unit with a support; a retention ring being fixed to said support; a screw or a threaded rod, having a head fixed to said support by said retention ring; and said screw or threaded rod having its threaded part going through a nut attached to the central unit, so that tightening and loosening the screw allows the movement of the central unit in respect of the side unit.

12. A door according to claim 6 wherein said first and second side units may be moved inwardly and outwardly in a coordinated manner, so that their movement is symmetric in respect of the central unit.

13. A door according to claim 12 having a screw connecting said first side unit to said second side unit and going through the central unit, said screw having a right threaded portion, and a left threaded portion.

14. A door according to claim 13 having in each of said side units a support for a nut and a nut fixed thereto, one of the nuts being right threaded and the other being left threaded.

15. A door according to claim 14 wherein the central unit includes a plurality of members movable in respect of each other.

16. A door according to claim 15 wherein each of said members has at least one neighboring member and overlaps therewith.

17. A door according to claim 14 wherein the members of the central unit and the side units may be moved in a coordinated manner.

18. A door with an adjustable height and an adjustable width, comprising a central unit, a bottom unit overlapping with said central unit to define a bottom overlapping region, a first and second side units, each of which overlaps with said central unit, a first corner unit overlapping with said first side unit and with said bottom unit, and a second corner unit overlapping with said second side unit and with said bottom unit;

said height being adjustable by changing the size of said bottom overlapping region;

said width being adjustable by moving said side units inwardly or outwardly in a coordinated manner, such that their movement is symmetric in respect of the central unit; and the first and second corner units are attached to the first and second side units, respectively, and to the bottom unit in a manner ensuring that the shape of the door as a whole is rectangular at any height and width to which the door is adjusted wherein the central unit has a main portion and a top portion having a width equal to that of the lower portion of the bottom unit.

* * * * *

UNITED STATES PATENT AND TRADEMARK OFFICE

CERTIFICATE OF CORRECTION

PATENT NO. : 6,892,506 B2
APPLICATION NO. : 10/394572
DATED : May 17, 2005
INVENTOR(S) : Skublevitz It is certified that error appears in the above-identified patent and that said Letters Patent is hereby corrected as shown below:

On the cover page, in section 73, the assignee's name should read --Mifalei Etz Karmiel Ltd.--.

Signed and Sealed this

Twenty-eighth Day of November, 2006

JON W. DUDAS
*Director of the United States Patent and Trademark Office*